US012270590B2

(12) United States Patent
Lee et al.

(10) Patent No.: US 12,270,590 B2
(45) Date of Patent: Apr. 8, 2025

(54) REFRIGERATOR

(71) Applicant: SAMSUNG ELECTRONICS CO., LTD., Suwon-si (KR)

(72) Inventors: Joo Yong Lee, Suwon-si (KR); Il Sung Bae, Suwon-si (KR); Joo Hee Song, Suwon-si (KR); Byung Kwan Yang, Suwon-si (KR); Jae Pil Cho, Suwon-si (KR); Hyo Ju Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 433 days.

(21) Appl. No.: 17/427,242

(22) PCT Filed: Jan. 29, 2020

(86) PCT No.: PCT/KR2020/001309

§ 371 (c)(1),
(2) Date: Jul. 30, 2021

(87) PCT Pub. No.: WO2020/159205

PCT Pub. Date: Aug. 6, 2020

(65) Prior Publication Data

US 2022/0099352 A1 Mar. 31, 2022

(30) Foreign Application Priority Data

Feb. 1, 2019 (KR) ..... 10-2019-0013821

(51) Int. Cl.

| | |
|---|---|
| ***F25D 17/06*** | (2006.01) |
| ***F25D 17/04*** | (2006.01) |
| ***F25D 21/14*** | (2006.01) |

(52) U.S. Cl.

CPC ..... *F25D 17/065* (2013.01); *F25D 17/045* (2013.01); *F25D 21/14* (2013.01); *F25D 2317/067* (2013.01)

(58) Field of Classification Search

CPC ..... F25D 17/065; F25D 17/045; F25D 21/14; F25D 2317/067; F25D 2317/0683;
(Continued)

(56) References Cited

U.S. PATENT DOCUMENTS

| | | | |
|---|---|---|---|
| 3,375,679 | A | 4/1968 | Helsel |
| 3,403,533 | A | 10/1968 | Bollenbacher |

(Continued)

FOREIGN PATENT DOCUMENTS

| | | | |
|---|---|---|---|
| CN | 1354353 | A | 6/2002 |
| CN | 1648564 | A | 8/2005 |

(Continued)

OTHER PUBLICATIONS

CN 208312828 U Translation (Year: 2019).*

(Continued)

*Primary Examiner* — Elizabeth J Martin
*Assistant Examiner* — Dario Antonio Deleon
(74) *Attorney, Agent, or Firm* — Nixon & Vanderhye P.C.

(57) ABSTRACT

A refrigerator includes a main body, a first storage chamber and a second storage chamber provided inside the main body with front sides thereof open. An evaporator is arranged inside the main body and is configured to generate cold air and arranged behind the first storage chamber. A first duct is configured to supply the cold air generated from the evaporator to the first storage chamber and a second duct is configured to supply cold air to the second storage chamber. A connection duct is configured to connect the first duct and the second duct to cause the cold air inside the first duct to flow into the second duct, and a damper is configured to selectively open and close the connection duct. The damper is provided inside the first duct, and the second duct has a flat front surface.

15 Claims, 13 Drawing Sheets

(58) Field of Classification Search
CPC ..... F25D 17/08; F25D 11/02; F25D 2201/12; F25D 2317/063; F25D 2317/0661; F25D 23/065
See application file for complete search history.

(56) References Cited

U.S. PATENT DOCUMENTS

| | | | | |
|---|---|---|---|---|
| 6,655,169 | B2 | 1/2003 | Tupis | |
| 6,675,604 | B2 | 1/2004 | Lee et al. | |
| 6,802,369 | B2 | 10/2004 | Zentner | |
| 6,840,057 | B2 | 1/2005 | Yun | |
| 7,036,334 | B2 | 5/2006 | Ko | |
| 7,240,512 | B2 | 7/2007 | Lee et al. | |
| 9,581,377 | B2 | 2/2017 | Kim et al. | |
| 9,970,699 | B2 | 5/2018 | Allard et al. | |
| 10,408,527 | B2 | 9/2019 | Cho et al. | |
| 2002/0116943 | A1 | 8/2002 | Tupis | |
| 2011/0041538 | A1 | 2/2011 | Yoon | |
| 2011/0162393 | A1 | 7/2011 | Kuehl et al. | |
| 2012/0011879 | A1 | 1/2012 | Gu | |
| 2017/0051964 | A1* | 2/2017 | Saito et al. | F25D 17/08 |
| 2017/0059228 | A1 | 3/2017 | Hu | |
| 2018/0172331 | A1 | 6/2018 | Tomohiko | |

FOREIGN PATENT DOCUMENTS

| | | | | | |
|---|---|---|---|---|---|
| CN | 201159568 | Y | * | 12/2008 | F25D 21/04 |
| CN | 103097839 | A | | 5/2013 | |
| CN | 105042990 | A | | 11/2015 | |
| CN | 107300288 | A | | 10/2017 | |
| CN | 108344224 | A | | 7/2018 | |
| CN | 108444175 | A | * | 8/2018 | F25D 17/045 |
| CN | 108548355 | A | | 9/2018 | |
| CN | 208312828 | U | * | 1/2019 | F25D 17/04 |
| CN | 109696010 | A | | 4/2019 | |
| JP | H1068573 | A | * | 3/1998 | F25D 19/006 |
| JP | 2003-75040 | A | | 3/2003 | |
| JP | 2006132820 | A | * | 5/2006 | F25D 17/06 |
| JP | 2017-110823 | A | | 6/2017 | |
| KR | 0124596 | Y1 | | 6/1998 | |
| KR | 10-0259920 | B1 | | 6/2000 | |
| KR | 10-0378824 | | | 4/2003 | |
| KR | 10-0402886 | B1 | | 10/2003 | |
| KR | 10-0408238 | B1 | | 12/2003 | |
| KR | 10-2004-0046870 | | | 6/2004 | |
| KR | 20040046870 | A | * | 6/2004 | F25D 17/08 |
| KR | 10-2005-0069320 | | | 7/2005 | |
| KR | 20050069320 | A | * | 7/2005 | F25D 17/08 |
| KR | 10-2005-0077844 | | | 8/2005 | |
| KR | 10-2005-0114531 | A | | 12/2005 | |
| KR | 10-2006-0000217 | A | | 1/2006 | |
| KR | 10-0547325 | B1 | | 1/2006 | |
| KR | 2006-0111274 | A | | 10/2006 | |
| KR | 10-0828046 | B1 | | 5/2008 | |
| KR | 10-2011-0011510 | | | 2/2011 | |
| KR | 10-1067107 | | | 9/2011 | |
| KR | 10-1072450 | | | 10/2011 | |
| KR | 2011-0011510 | U | | 12/2011 | |
| KR | 10-1408769 | B1 | | 6/2014 | |
| KR | 10-2015-0019997 | | | 2/2015 | |
| KR | 10-2015-0053064 | A | | 5/2015 | |
| KR | 10-2015-0056142 | | | 5/2015 | |
| KR | 10-2016-0057897 | | | 5/2016 | |
| KR | 20160057897 | A | * | 5/2016 | F25D 29/00 |
| KR | 101697551 | B1 | * | 1/2017 | F25D 21/14 |
| KR | 10-2017-0065948 | A | | 6/2017 | |
| KR | 2018-0035144 | A | | 4/2018 | |
| WO | WO 2019/153914 | A1 | | 8/2019 | |

OTHER PUBLICATIONS

CN 108444175 Translation (Year: 2018).*
KR 101697551 B1 Translation (Year: 2017).*
KR 20160057897 A Translation (Year: 2016).*
CN 201159568 Y Translation (Year: 2008).*
JP 2006132820 A Translation (Year: 2006).*
KR 20050069320 A Translation (Year: 2005).*
KR 20040046870 A Translation (Year: 2004).*
JP H1068573 A Translation (Year: 1998).*
Extended European Search Report mailed Feb. 8, 2022 in European Application No. 20748728.1, 7 pages.
Korean Notice of Allowance dated Sep. 27, 2022 for KR Application No. 10-2022-0009307.
Korean Notice of Allowance dated Oct. 25, 2022 for KR Application No. 10-2022-0009304.
European Extended Search Report dated Nov. 9, 2022 for EP Application No. 22186892.0.
European Extended Search Report dated Dec. 20, 2022 for EP Application No. 22205472.8.
Notice of Preliminary Rejection mailed Apr. 20, 2022 in Korean Application No. 10-2022-0009304, with English translation, 14 pages.
Notice of Preliminary Rejection mailed Apr. 20, 2022 in Korean Application No. 10-2022-0009307, with English translation, 16 pages.
U.S. Appl. No. 17/732,578, filed Apr. 29, 2022; Lee et al.
U.S. Appl. No. 17/846,081, filed Jun. 22, 2022; Lee et al.
International Search Report dated Jun. 2, 2020 from International Application No. PCT/KR2020/001309.
European Office Action dated May 31, 2023 for EP Application No. 22 186 892.0.
Office Action for U.S. Appl. No. 17/846,041 dated Aug. 2, 2023.
Non-Final Rejection dated Jul. 29, 2022 for U.S. Appl. No. 17/732,578; Lee et al.
Final Rejection dated Nov. 22, 2022 for U.S. Appl. No. 17/732,578; Lee et al.
Non-Final Rejection dated Oct. 13, 2022 for U.S. Appl. No. 17/846,081; Lee et al.
First Office Action mailed Oct. 19, 2023 in Chinese Application No. 202080011639.3, with English translation, 17 pages.
Communication Pursuant to Article 94(3) EPC mailed Nov. 15, 2023 in European Application No. 20 748 728.1, 5 pages.
Korean Office Action dated Aug. 17, 2023 for KR Application No. 10-2019-0013821.
European Examination Report dated Oct. 4, 2023 for EP Application No. 22186892.0.
Office Action mailed Jul. 30, 2024 in European Application No. 22 205 472.8, 5 pages.
Notice Requesting Submission of Opinion mailed Nov. 4, 2024 in Korean Application No. 10-2024-0141603, with English translation, 9 pages.

* cited by examiner

REFRIGERATOR

CROSS-REFERENCE TO RELATED APPLICATIONS

This application is a U.S. National Stage Application, which claims the benefit under 35 U.S.C. § 371 of International Patent Application No. PCT/KR2020/001309, filed on Jan. 29, 2020. The International Application claims the priority benefit of Korean Patent Application No. 10-2019-0013821 filed on Feb. 2, 2019. The contents of both International Application No. PCT/KR2020/001309 and Korean Patent Application No. 10-2019-0013821 are incorporated by reference herein in their entirety.

TECHNICAL FIELD

The disclosure relates to a refrigerator for controlling the temperature of a storage chamber through a single evaporator.

BACKGROUND ART

A refrigerator is a home appliance that is equipped with a main body having a storage chamber, a cold air supply device provided to supply cold air to the storage chamber, and a door provided to open and close the storage chamber so that food is kept in a fresh state. The storage chamber includes a refrigerating chamber maintained at about 0° C. to 5° C. to store food refrigerated, and a freezing chamber maintained at about 0° C. to −30° C. to store food frozen.

The refrigerator may be classified according to the positions of the refrigerating chamber and the freezing chamber into a Bottom Mounted Freezer (BMF)-type refrigerator provided with a freezing chamber at the lower side and a refrigerating chamber formed at the upper side, a Top Mounted Freezer (TMP)-type refrigerator provided with a freezing chamber formed at the upper side and a refrigerating chamber formed at the lower side, and a Side By Side (SBS)-type refrigerator provided with the freezing chamber and the refrigerating chamber laterally arranged in a left-right direction. Further, the refrigerator may be classified according to the number of doors into a two-door refrigerator, a three-door refrigerator, and a four-door refrigerator.

In order to supply cold air to the refrigerating chamber and the freezing chamber, an evaporator may be installed in each of the refrigerating chamber and the freezing chamber. In addition, cold air may be supplied to the refrigerating chamber and the freezing chamber through a single evaporator.

SUMMARY

Technical Problem

The present application is directed to providing a refrigerator in which cold air is supplied to a refrigerating chamber and a freezing chamber through a single evaporator so that a cold air supply device is provided with a simple structure.

The present application is directed to providing a refrigerator having an improved structure in which a damper provided to maintain a temperature difference between a refrigerating chamber and a refrigerating chamber duct is arranged inside a freezing chamber.

Technical Solution

One aspect of the present application provides a refrigerator including: a main body; a first storage chamber and a second storage chamber provided inside the main body with front sides thereof open and arranged in a left-right direction; an evaporator arranged inside the main body and configured to generate cold air, the evaporator arranged behind the first storage chamber; a first duct configured to supply the cold air generated from the evaporator to the first storage chamber, a second duct configured to supply cold air to the second storage chamber, and a connection duct configured to connect the first duct and the second duct to cause the cold air inside the first duct to flow into the second duct; and a damper configured to selectively open and close the connection duct, wherein the damper is provided inside the first duct, and the second duct has a front surface in a form of a flat surface.

The second duct may not include a part that protrudes forward of the flat surface.

The first duct may form a rear surface of the first storage chamber, and the second duct may form a rear surface of the second storage chamber; and the second duct may be arranged rearward than the first duct in a front-rear direction.

The connection duct may have one end coupled to a side surface of the first duct, and an other end of the connection duct coupled to a rear surface of the second duct.

The damper may be arranged to be inclined in a first direction that is vertically perpendicular to a front-rear direction.

The damper may be arranged to be inclined in a second direction that is horizontally perpendicular to a front-rear direction.

The damper may further include a drain part provided at a lower end of the damper to drain condensate water.

The drain part may be provided so that the condensate water drained from the drain part falls toward the evaporator.

The damper may include a door configured to selectively open and close the connection duct, and a driving part configured to drive the door frame and the door.

The door may be rotated in a direction toward the first duct from the connection duct to open the connection duct.

The door frame may include a heating wire arranged in an area that is in contact with the door frame when the door is in a closed state.

The connection duct may include a rib that is arranged inside the connection duct and including a collecting part formed in a direction toward an other end of the connection duct.

The refrigerator may further include a first inner case configured to form the first storage chamber, a second inner case configured to form the second storage chamber, and a cooling passage in which the evaporator is arranged and which is formed between a rear surface of the first storage chamber and a rear surface of the first inner case.

The first duct may be provided to communicate with the cooling passage, and the first duct may include a blower fan that allows cold air in the cooling passage to flow to the first duct and the second duct.

Another aspect of the present application provides a refrigerator including: a main body; a freezing chamber and a refrigerating chamber provided inside the main body and arranged in a left-right direction; a cooling passage in which an evaporator arranged at a rear side of the freezing chamber and configured to generate cold air is arranged; a first duct configured to communicate with the cooling passage to supply the cold air to the freezing chamber, a second duct configured to supply cold air to the refrigerating chamber, and a connection duct configured to connect the first duct and the second duct to cause the cold air inside the first duct to flow into the second duct; and a damper configured to selectively open and close the connection duct, wherein the damper is arranged at a rear side of the freezing chamber, and arranged to be inclined in a first direction perpendicular to a upper-lower direction.

The second duct may have a front surface without a protruding part.

The damper may be arranged to be inclined in a second direction that is perpendicular to the upper-lower direction and the first direction.

The damper may include a drain part provided at a lower end of the damper, the drain part formed by the inclined arrangement of the damper with respect to the first direction and the second direction, so that condensate water drained from the drain part is fallen toward the evaporator.

The damper may include a door configured to selectively open and close the connection duct, and a driving part configured to drive the door frame and the door, and the door may be provided to open the connection duct by rotating in a direction from the connection duct to the first duct.

Another aspect of the present application provides a refrigerator including: a main body; a freezing chamber and a refrigerating chamber provided inside the main body and arranged in a left-right direction; a cooling passage in which an evaporator arranged at a rear side of the freezing chamber and configured to generate cold air is arranged; a first duct configured to communicate with the cooling passage to supply the cold air to the freezing chamber, a second duct configured to supply cold air to the refrigerating chamber, and a connection duct configured to connect the first duct and the second duct to cause the cold air inside the first duct to flow into the second duct; and a damper configured to selectively open and close the connection duct, wherein the damper is arranged inside the first duct, the second duct is arranged rearward than the first duct, one end of the connection duct is coupled to a side surface of the first duct, and the other end of the connection duct is coupled to a rear surface of the second duct.

Advantageous Effects

According to an embodiment of the disclosure, a damper arranged between a refrigerating chamber duct and a freezing chamber duct is arranged on a side of the freezing chamber so that the capacity of the refrigerating chamber can be increased. With respect to dew condensation that may occur due to the duct being arranged on the side of the freezing chamber, the damper is slantingly arranged with respect to the vertical direction so that condensate water can be easily drained to prevent dew condensation.

DETAILED DESCRIPTION

Figure 1:
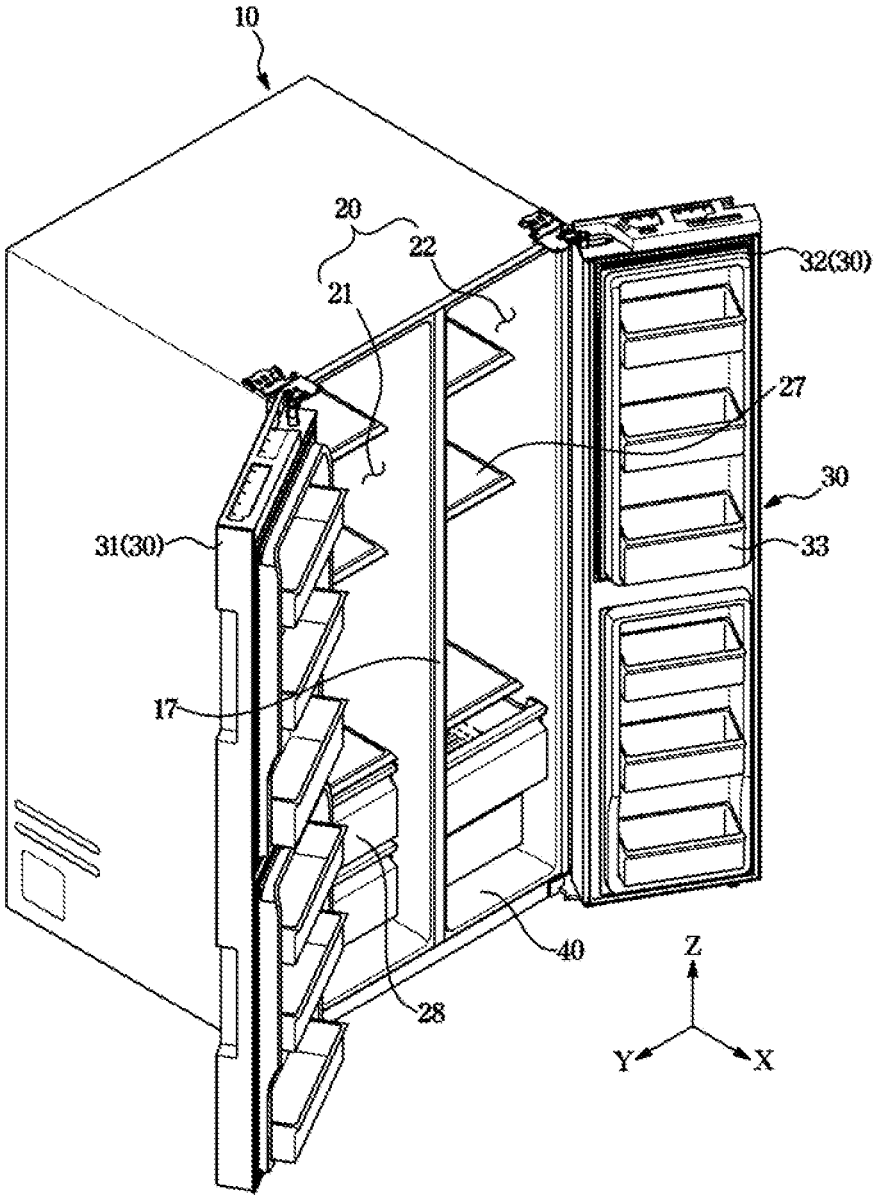
FIG. 1 is a perspective view illustrating a refrigerator according to an embodiment of the disclosure.

The embodiments set forth herein and illustrated in the configuration of the disclosure are only the most preferred embodiments and are not representative of the full the technical spirit of the disclosure, so it should be understood that they may be replaced with various equivalents and modifications.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Hereinafter, embodiments of the disclosure will be described in detail with reference to the accompanying drawings.

Figure 2:
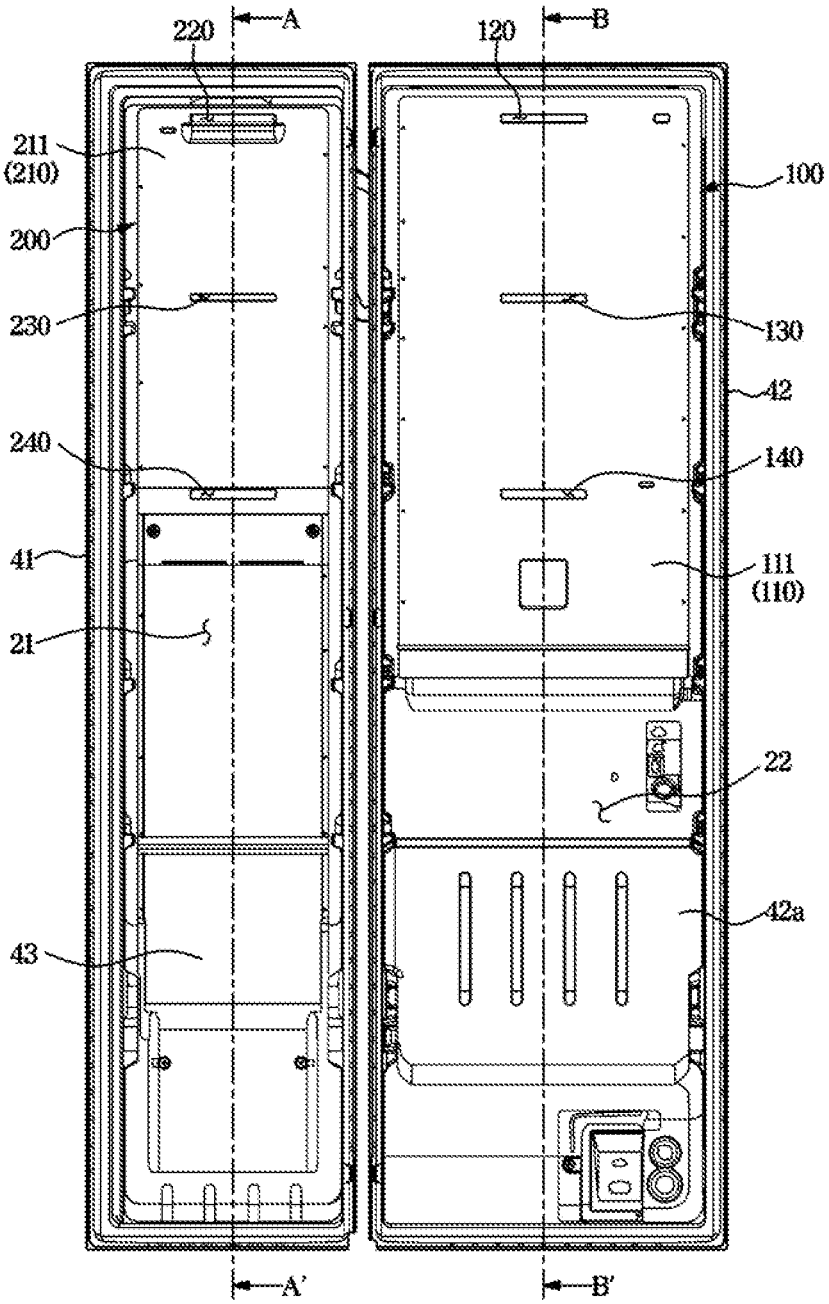
FIG. 2 is a front view illustrating a part of a refrigerator according to an embodiment of the disclosure.
Figure 3:
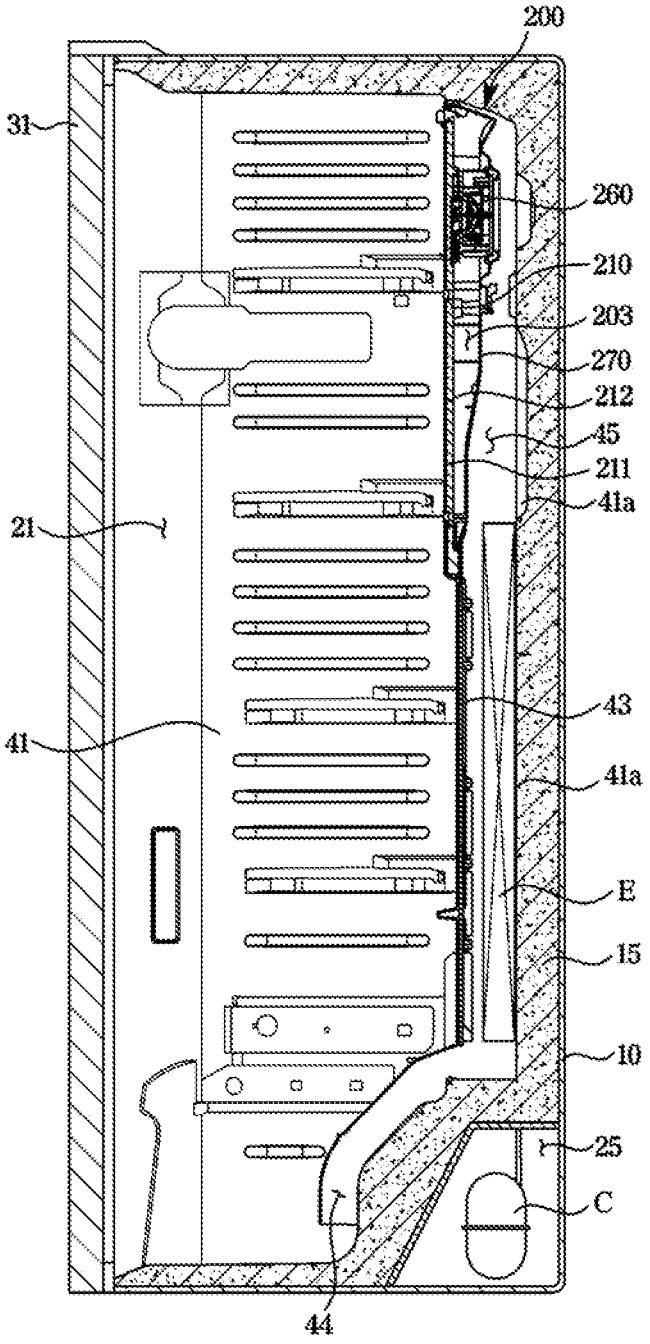
FIG. 3 is a side cross-sectional view taken along line AA' shown in FIG. 2.
Figure 4:
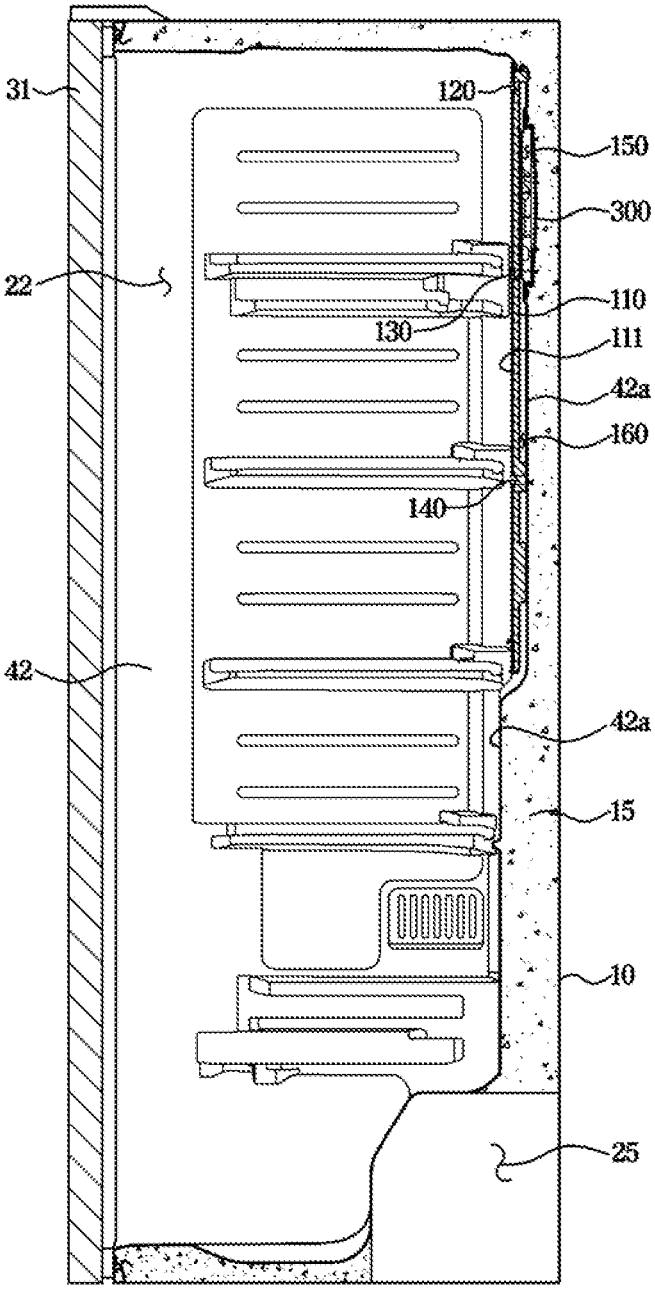
FIG. 4 is a side cross-sectional view taken along line BB' shown in FIG. 2.
Figure 5:
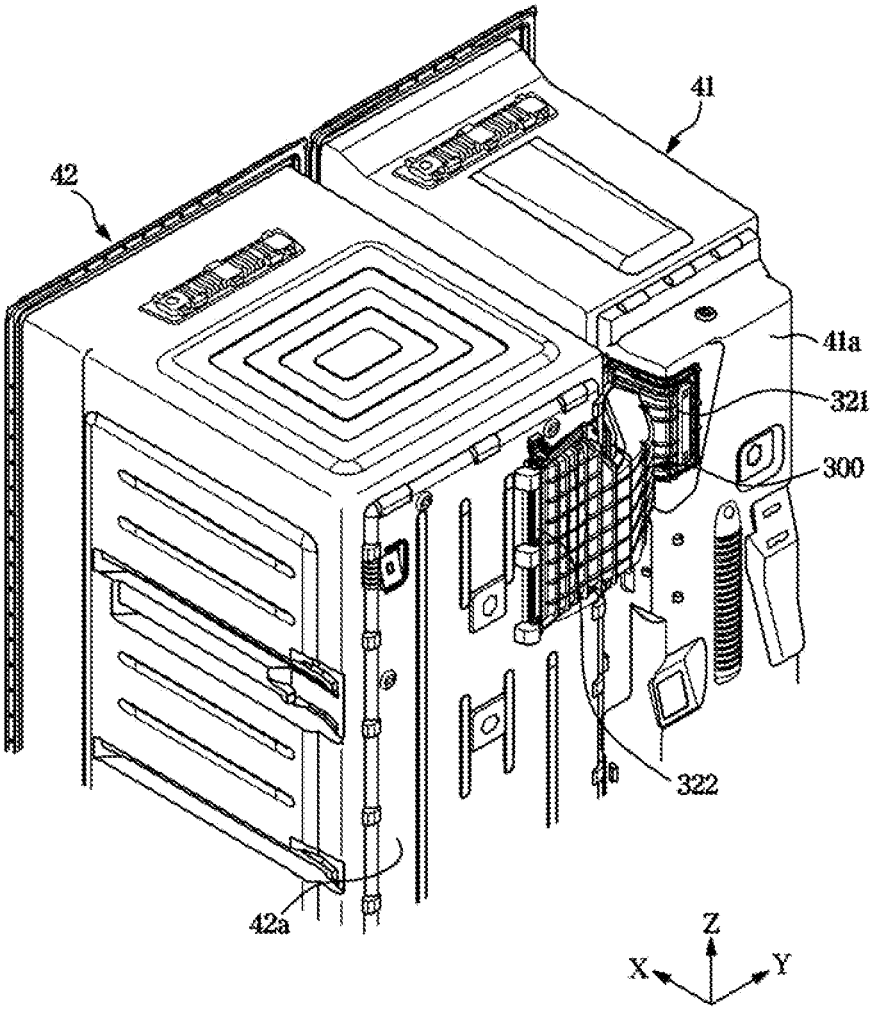
FIG. 5 is a view illustrating inner cases of a freezing chamber and a refrigerating chamber and a connection duct, which is viewed from the rear, according to an embodiment of the disclosure.
Figure 6:
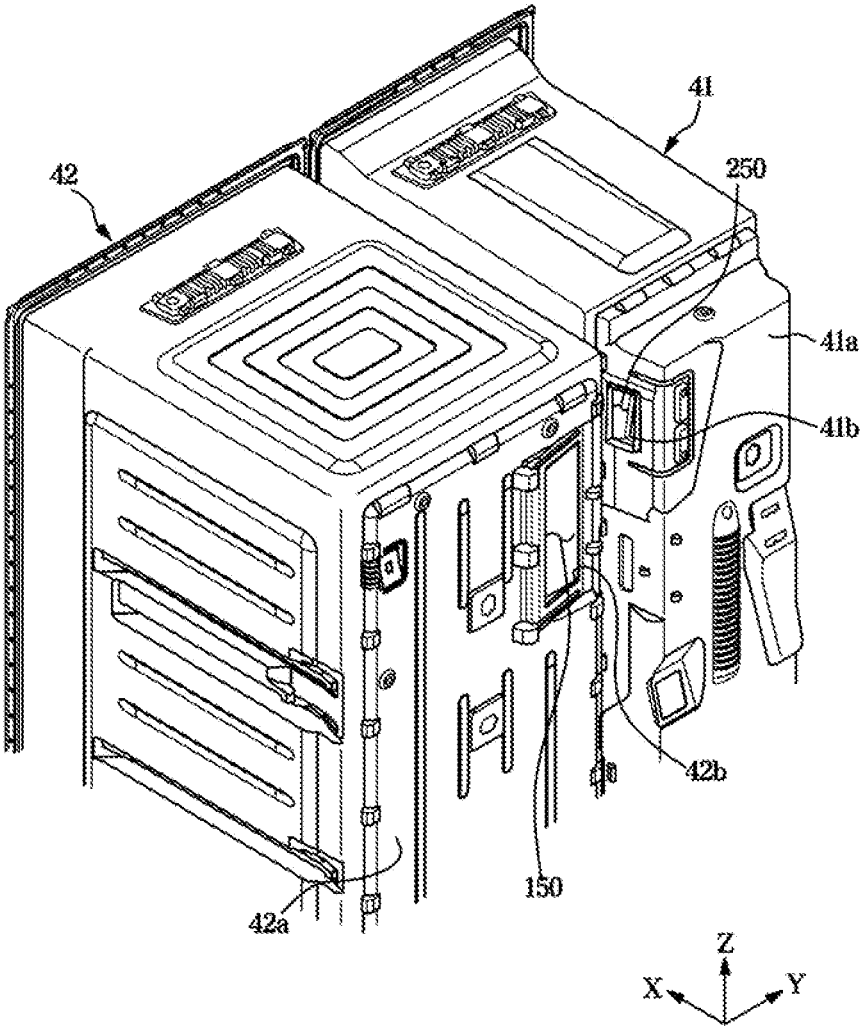
FIG. 6 is a view illustrating inner cases of a freezing chamber and a refrigerating chamber, which is viewed from the rear, according to an embodiment of the disclosure.

FIG. 1 is a perspective view illustrating a refrigerator according to an embodiment of the disclosure, FIG. 2 is a front view illustrating a part of a refrigerator according to an embodiment of the disclosure, FIG. 3 is a side cross-sectional view taken along line AA' shown in FIG. 2, FIG. 4 is a side cross-sectional view taken along line BB' shown in FIG. 2, and FIG. 5 is a view illustrating inner cases of a freezing chamber and a refrigerating chamber and a connection duct, which is viewed from the rear, according to an embodiment of the disclosure, FIG. 6 is a view illustrating inner cases of a freezing chamber and a refrigerating chamber, which is viewed from the rear, according to an embodiment of the disclosure.

Referring to FIGS. 1 to 4, a refrigerator includes a main body 10, which is also referred to as an outer case) forming the external appearance, a storage chamber 20 inside the main body 10 having a front side thereof openable and accommodating a storage box 28, and the like, and a door 30 rotatably coupled to the main body 10 to open and close the front open side of the storage chamber 20.

The main body 10 includes an inner case 40 forming the storage chamber 20 and a cold air supply device configured to supply cold air to the storage chamber 20.

The cold air supply device may include a compressor C, a condenser (not shown), an expansion valve (not shown), and an evaporator (E), and between the main body 10 and the inner case 40 and inside the door 30, heat insulating material 15 is foamed and filled to prevent cold air from leaking out of the storage chamber 20.

The storage chamber 20 is provided inside the main body 10 and has a front side that is openable, and the opened front side is opened and closed by the door 30.

The storage chamber 20 may be divided into a plurality of storage chambers by a partition wall 17. The storage chamber 20 may include a freezing chamber 21 and a refrigerating chamber 22 partitioned in the left-right direction by the partition wall 17.

The inner case 40 may include a freezing chamber inner case 41 forming the freezing chamber 21 and a refrigerating chamber inner case 42 forming the refrigerating chamber 22. The freezing chamber inner case 41 and the refrigerating chamber inner case 42 may be arranged on the left side and right side with respect to the partition wall 17.

The storage chamber 20 is provided at a rear lower side thereof with a machine room 25 in which a compressor C for compressing a refrigerant and a condenser (not shown) for condensing the compressed refrigerant are installed.

The storage chamber 20 may be provided therein with a plurality of shelves 27 and a storage box 28 to store food and the like.

The door 30 is rotatably coupled to the main body 10 to open and close the open front side of the storage chamber 20. The freezing chamber 21 and the refrigerating chamber 22 may be opened and closed by a first door 31 and a second door 32 rotatably coupled to the main body 10, respectively.

Although the refrigerator according to an embodiment of the disclosure may be provided as a double-door type refrigerator, the refrigerator may be provided as a Top Mounted Freezer (TMF) type refrigerator in which the freezing chamber 21 and the refrigerating chamber 22 are arranged on the upper side and the lower side, respectively, or as a bottom mounted freezer (BMF) in which the refrigerating chamber 22 and the freezing chamber 21 are arranged on the upper side and the lower side, respectively.

In addition, the disclosure is not limited thereto, and the storage chamber 20 may be divided into three or more chambers by the partition wall 17.

A plurality of door guards 33 capable of accommodating food and the like may be provided on the rear surface of the door 30.

The freezing chamber 21 may be provided at an inner side thereof with a freezing chamber duct 200 configured to supply cold air to the freezing chamber 21. The refrigerating chamber 22 may be provided at an inner side thereof with a refrigerating chamber duct 100 configured to supply cold air to the refrigerating chamber 22.

The freezing chamber duct 200 may be arranged on the upper end of the rear side of the freezing chamber 21. At the lower side of the freezing chamber duct 200, a separating plate 43 that forms the rear surface of the freezing chamber 21 together with the freezing chamber duct 200 may be arranged.

The freezing chamber duct 200 and the separating plate 43 may be arranged forward than a freezing chamber inner case rear surface 41*a*. Accordingly, a cooling space 45 may be formed by the freezing chamber duct 200, the separating plate 43, and the freezing chamber inner case rear surface 41*a*.

An evaporator E may be arranged in the cooling space 45. In addition, a passage through which cold air generated in the evaporator E flows to the freezing chamber duct 200 may be formed.

The freezing chamber 21 may be formed by an inner surface of the freezing chamber inner case 41, a front surface 211 of a duct plate 210 of the freezing chamber duct 200, and the separating plate 43. That is, the rear surface of the freezing chamber 21 may be formed by the front surface 211 of the duct plate 210 of the freezing chamber duct 200 and the separating plate 43, and the side surfaces of the freezing chamber 21 may be formed by inner surfaces of the freezing chamber inner case 41.

The freezing chamber duct 200 may include the duct plate 210 and a duct cover 270 that covers a rear surface 212 of the duct plate 210 from the rear of the duct plate 210. In addition, the freezing chamber duct 200 may include an internal space 203 formed between the duct plate 210 and the duct cover 270.

The freezing chamber duct 200 may include a blower fan 260 arranged on the rear surface 212 of the duct plate 210 and provided so that the cold air formed in the cooling space 45 is introduced into the freezing chamber duct 200.

Cold air in the cooling space 45 may flow upward by the blower fan 260 and may be introduced into the freezing chamber duct 200 through the blower fan 260.

The cold air introduced into the internal space 203 may be discharged to the freezing chamber 21 through freezing chamber discharge ports 220, 230, and 240 of the freezing chamber duct 200 by the blower fan 260.

The cold air formed in the cooling space 45 may be formed at approximately −20 degrees, and may be directly discharged to the freezing chamber 21 by the blower fan 260 to cool the freezing chamber 21.

The refrigerating chamber duct 100 may be arranged at an upper end of the rear side of the refrigerating chamber 22. At a lower side of the refrigerating chamber duct 100, a refrigerating chamber inner case rear surface 42*a* forming the rear surface of the refrigerating chamber 22 together with the refrigerating chamber duct 100 may be arranged.

The refrigerating chamber 22 may be formed by an inner surface of the refrigerating chamber inner case 42, a front surface 111 of a duct plate 110 of the refrigerating chamber duct 100, and a rear surface 42*a* of the refrigerating chamber inner case. That is, the rear surface of the refrigerating chamber 22 may be formed by the front surface 111 of the duct plate 110 of the refrigerating chamber duct 100 and the refrigerating chamber inner case rear surface 42*a*, and the side surfaces of the refrigerating chamber 22 may formed by the inner surfaces of the refrigerating chamber inner case 42.

A space may be formed between the duct plate 110 of the refrigerating chamber duct 100 and the refrigerating chamber inner case rear surface 42*a*. In the space, a passage for air introduced into the refrigerating chamber duct 100 may be formed.

The refrigerating chamber duct 100 does not additionally include an evaporator for supplying cold air. Therefore, cold air generated by the evaporator E communicating with the freezing chamber duct 200 flows into the refrigerating chamber duct 100 through the freezing chamber duct 200 and then is discharged from the refrigerating chamber duct 100 to keep the refrigerating chamber 22 at a low temperature.

On the front surface 111 of the duct plate 110 of the refrigerating chamber duct 100, discharge ports 120, 130, and 140 are provided for cold air flowing in an internal space 160 of the refrigerating chamber duct 100 to be discharged to the refrigerating chamber 22.

A circulation passage 44 communicated with the machine room 25 and provided to introduce circulated cold air into the machine room 25 may be arranged at a lower side of the freezing chamber inner case 41.

A second circulation passage (not shown) that is directly connected to the storage chamber 25 or communicates with the lower side of the freezing chamber inner case 41 may be arranged at a lower side of the refrigerating chamber inner case 42.

The cold air circulated in the freezing chamber 21 and the refrigerating chamber 22 through the circulation passage 44 and the second circulation passage (not shown) flows back into the machine chamber 25 so that the cold air is supplied to the freezing chamber 21 and the refrigerating chamber 22 through a single evaporator E.

Referring to FIGS. 5 and 6, between the freezing chamber duct 200 and the refrigerating chamber duct 100, a connection duct 300 for connecting the freezing chamber duct 200 to the refrigerating chamber duct 100 so that the cold air inside the freezing chamber duct 200 flows to the refrigerating chamber duct 100 may be provided.

The connection duct 300 has one end 321 connected to an outlet 250 of the freezing chamber duct 200 through which cold air in the freezing chamber duct 200 flows out, and an other end 322 connected to a connector 150 of the refrigerating chamber duct 100 that is connected to the connection duct 300 so that cold air is introduced from the freezing chamber duct 200.

The air cooled in the cooling space 45 by the blower fan 260 may flow into the freezing chamber duct 200, and a part of the cold air introduced into the freezing chamber duct 200 may be discharged through the discharge ports 220, 230, and 240 of the freezing chamber duct 200 into the freezing chamber 21, and the other part of the cold air may be introduced into the refrigerating chamber duct 100 through the connection duct 300.

As described above, the cold air formed in the cooling space 45 maintains a temperature of about −20 degrees, but the refrigerating chamber 22 needs to maintain a temperature of about 0 degrees or more. Therefore, to prevent additional low-temperature cold air from flowing into the refrigerating chamber 22 when the internal temperature of the refrigerating chamber 22 is maintained at about 0 degrees, a damper 400 that selectively opens and closes the connection duct 300 may be provided at one end of the connection duct 300.

In the conventional case, the damper is arranged on the side of the refrigerating chamber. Specifically, the damper is arranged inside the refrigerating chamber duct, and selectively opens and closes the connector of the refrigerating chamber duct such that the other end of the connection duct selectively communicates with the refrigerating chamber duct.

Accordingly, the volume of the refrigerating chamber duct increases, and in particular, the refrigerating chamber duct protrudes forward in the amount corresponding to the space in which the damper is arranged, and thus the aesthetics of the refrigerating chamber is deteriorated, and the capacity of the refrigerating chamber is reduced, thereby reducing the efficiency of the refrigerator.

In order to solve the limitation, the damper 400 of the refrigerator 1 according to an embodiment of the disclosure is arranged inside the freezing chamber duct 200 to secure a wider space in the refrigerating chamber 22.

The freezing chamber duct 200 may be arranged forward than the refrigerating chamber duct 100. This is because the cooling space 45 in which the evaporator E is arranged is formed between the rear surface of the main body 10 and the freezing chamber 21.

That is, the length of the freezing chamber 21 in the front-rear direction X may be formed shorter than the length of the refrigerating chamber 22 in the front-rear direction X, and accordingly, the duct plate 210 of the freezing chamber duct 200 is arranged forward than the duct plate 110 of the refrigerating chamber duct 100.

As the duct plate 210 of the freezing chamber duct 200 is arranged forward than the duct plate 110 of the refrigerating chamber duct 100, the internal space 203 of the freezing chamber duct 200 has a larger width in the front-rear direction X than that of the internal space of the refrigerating chamber duct 100.

Accordingly, when the damper 400 is formed in the internal space 203 of the freezing chamber duct 200, the capacity loss of the freezing chamber 21 and the refrigerating chamber 22 may not occur.

In particular, in the conventional case, as the damper 400 is formed inside the duct 100 of the refrigerating chamber 22, a portion of the front surface 111 of the duct plate 110 of the refrigerating chamber duct 100 protrudes forward by the size of the damper 400. However, according to an embodiment of the disclosure, the front surface 111 of the duct plate 110 of the refrigerating chamber duct 100 may be provided as a flat surface without a protruding part.

The outlet 250 of the freezing chamber duct 200 connected to the one end 321 of the connection duct 300 may be arranged on the side surface of the freezing chamber duct 200, and communicate with an opening 41*b* formed on the side surface of the freezing chamber inner case 41.

The connector 150 of the refrigerating chamber duct 100 connected to the other end 322 of the connection duct 300 may be arranged on the rear surface of the refrigerating chamber duct 100, and may communicate with an opening 42*b* formed on the rear surface of the refrigerating chamber inner case 42.

In the conventional case, the freezing chamber duct and the refrigerating chamber duct are each connected at a side surface thereof to the connection duct, but since the connection duct 300 according to an embodiment of the disclosure is arranged rearward than the freezing chamber duct 200 without a part protruding forward from the refrigerating chamber duct 100. Accordingly, the other end 322 of the connection duct 300 may be coupled to the rear surface of the refrigerating chamber duct 100.

Hereinafter, the damper 400 will be described in detail.

Figure 7:
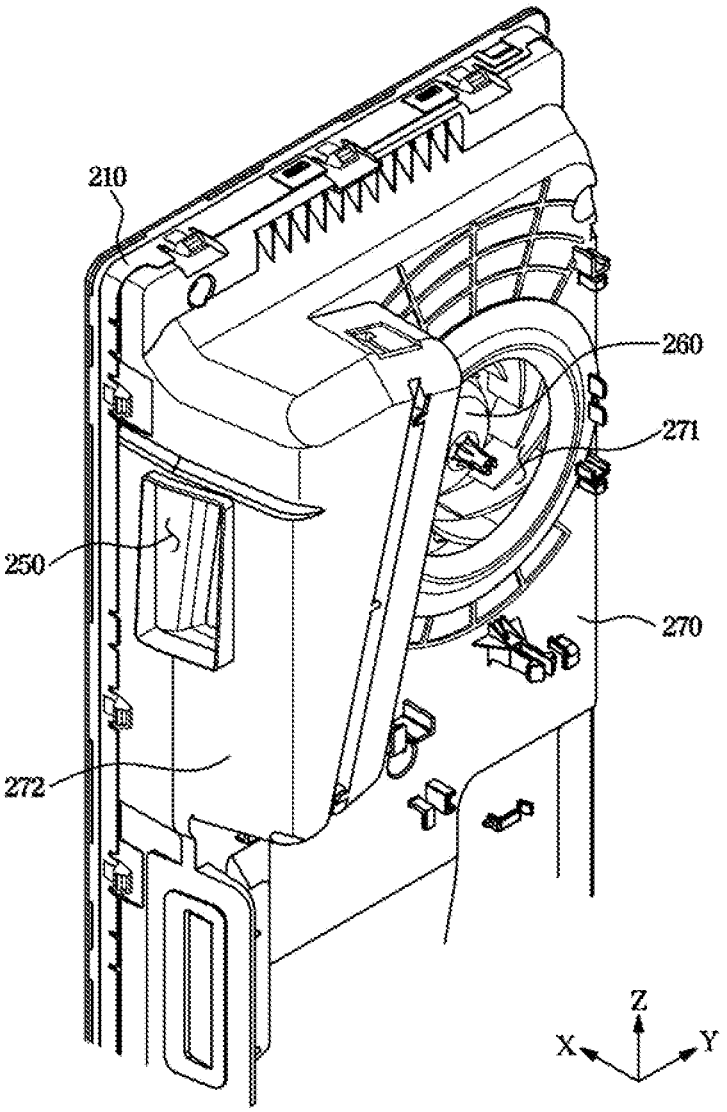
FIG. 7 is a view illustrating a freezing chamber duct, which is viewed from the rear, according to an embodiment of the disclosure.
Figure 8:
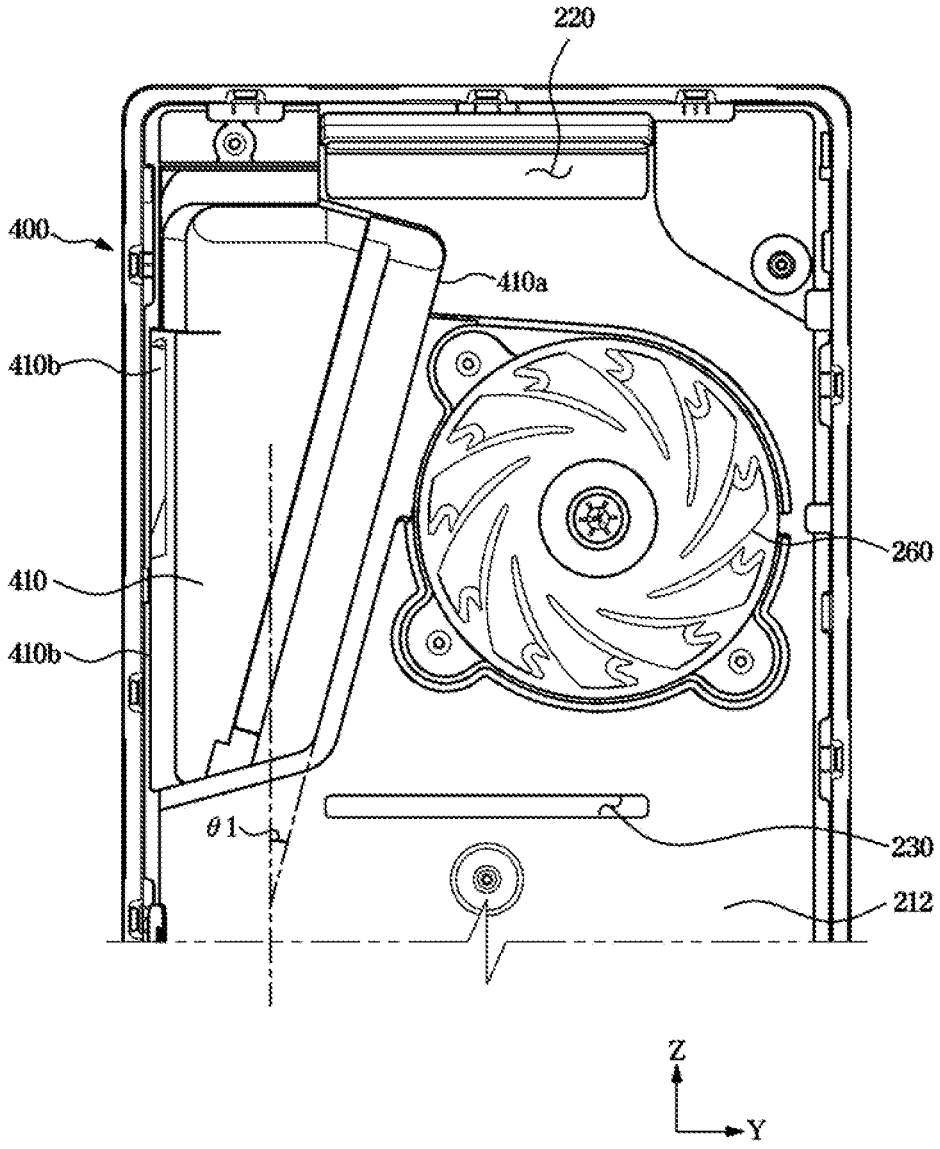
FIG. 8 is a rear view illustrating a state in which a duct cover is removed from a freezing chamber duct according to an embodiment of the disclosure.
Figure 9:
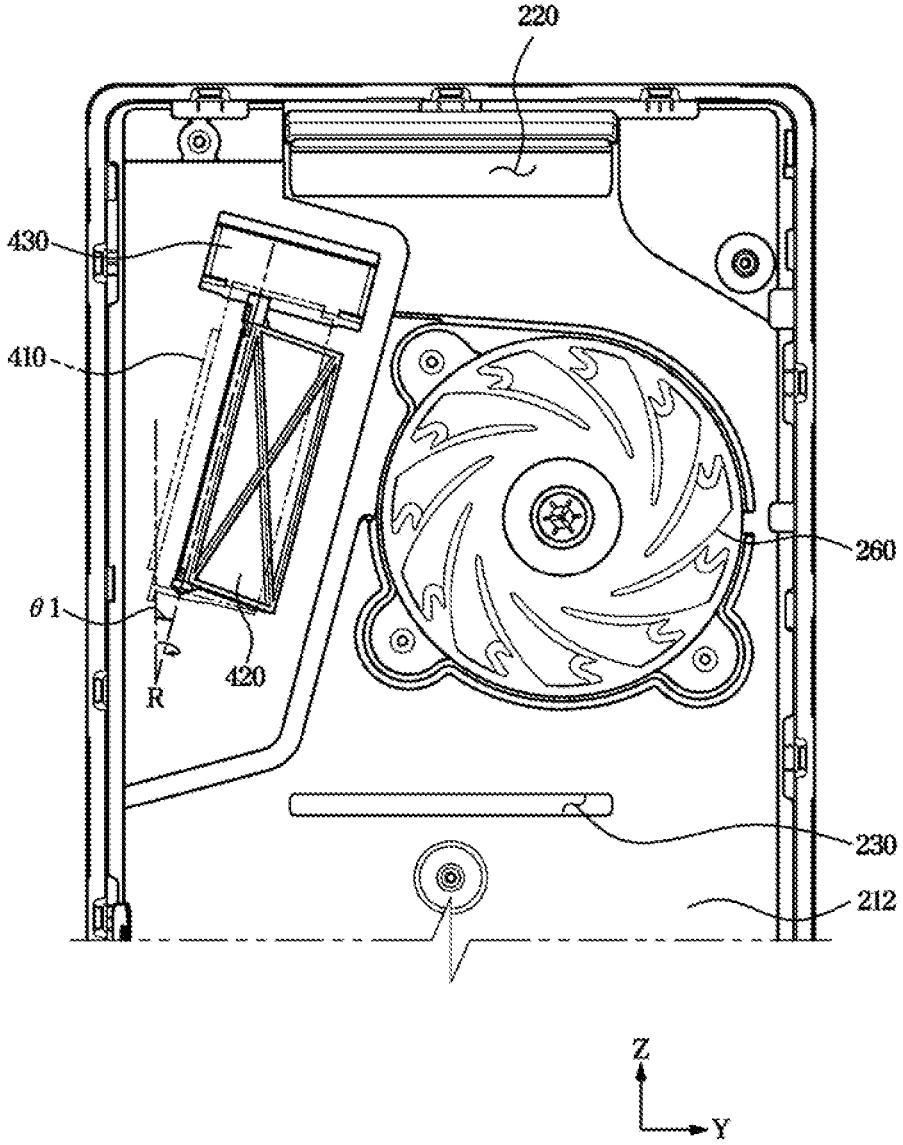
FIG. 9 is a view illustrating a state in which a damper frame is removed from FIG. 8.
Figure 10:
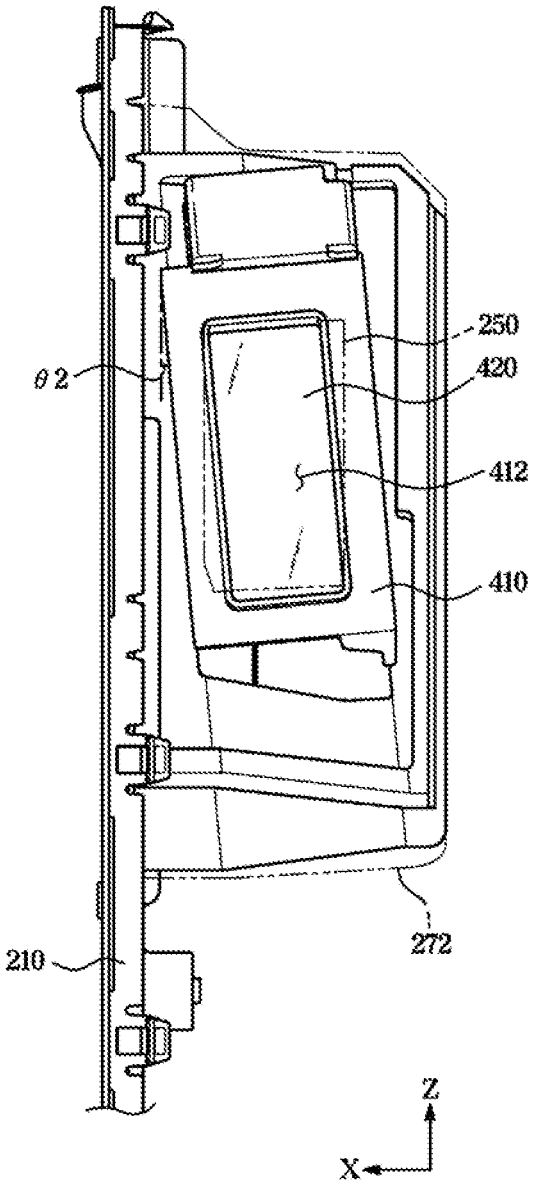
FIG. 10 is a side view illustrating a state in which a duct cover is removed from a freezing chamber duct according to an embodiment of the disclosure.
Figure 11:
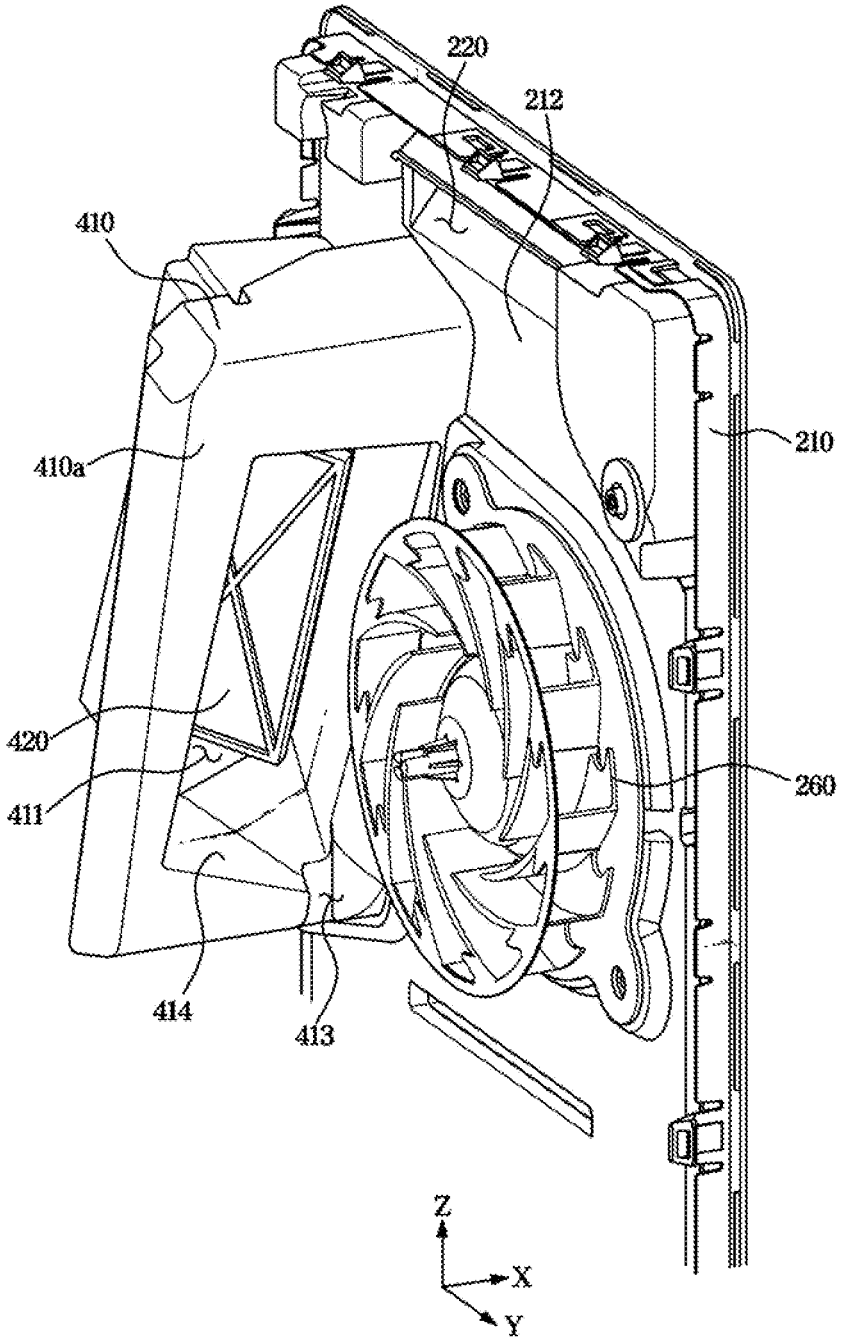
FIG. 11 is a rear perspective view illustrating a state in which a duct cover is removed from a freezing chamber duct according to an embodiment of the disclosure.

FIG. 7 is a view illustrating a freezing chamber duct, which is viewed from the rear according to an embodiment of the disclosure from the rear, FIG. 8 is a rear view illustrating a state in which a duct cover is removed from a freezing chamber duct according to an embodiment of the disclosure, FIG. 9 is a view illustrating a state in which a damper frame is removed from FIG. 8, FIG. 10 is a side view illustrating a state in which a duct cover is removed from a freezing chamber duct according to an embodiment of the disclosure, and FIG. 11 is a rear perspective view illustrating a state in which a duct cover is removed from a freezing chamber duct according to an embodiment of the disclosure.

Referring to FIGS. 7 to 9, the damper 400 may be arranged inside the freezing chamber duct 200.

The duct cover 270 of the freezing chamber duct 200 may include an inlet 271 that is opened to introduce air into the blower fan 260.

The duct cover 270 may include a damper housing part 272 extending to the rear side of the duct cover 270 to cover the damper 400 and having a shape substantially similar to the external appearance of the damper 400.

The damper housing part 272 is integrally formed with the duct cover 270, but the disclosure is not limited thereto, and the damper housing part 272 may be provided as a separate part from the duct cover 270 and coupled to the duct cover 270.

The outlet 250 communicating with the opening 41*b* of the freezing chamber inner case 41 may be arranged on a side surface of the damper housing part 272. The damper 400 arranged inside the damper housing part 272 may selectively open and closes the outlet 250 to restrict the flow of cold air flowing in the freezing chamber duct 200 to the connection duct 300 to thereby restrict cold air from being supplied to the refrigerating chamber duct 100.

The damper 400 includes a door 420 selectively opening and closing the outlet 250 or the one end 321 of the connection duct 300, and a driving part 430 for driving a door frame 410, to which the door 420 is rotatably coupled, and the door 420.

The door 420 may be rotated about a rotation axis R. The door 420 may open the outlet 250 by rotating about the rotation axis R in a direction opposite to the connection duct 300 or in a direction in which the blower fan 260 is arranged.

In addition, the door 420 may close the outlet 250 by rotating about the rotation axis R in the direction toward the connection duct 300. This is to drain condensate water that may be frozen between the door 420 and the door frame 410. This will be described below in detail.

The driving part 430 may be connected to the door 420 in the direction of the rotation axis R to rotate the door 420.

Unlike the conventional technology, since the damper 400 is arranged inside the freezing chamber duct 200, condensate water may be frozen inside the damper 400.

Different from the refrigerating chamber duct 100, the freezing chamber duct 200 is supplied with cold air of about −20 degrees so that water vapor in the air flowing inside the refrigerator 1 may collide with the damper 400 to generate condensate water, and the condensate water having collided with the damper 400 may be frozen inside the duct 400 by the low temperature formed inside the freezing chamber duct 200.

In particular, when condensate water is frozen between the door 420 and the door frame 410, the door 420 may be restricted in rotation and the damper 400 may be caused to malfunction.

Accordingly, the damper 400 according to an embodiment of the disclosure may arranged to be inclined with respect to an upper-lower direction Z so that when condensate water is generated inside the damper 400, the condensed water is easily drained.

In detail, referring to FIGS. 8 and 9, the damper 400 may be arranged at a predetermined angle θ1 in a left-right direction Y perpendicular to the upper-lower direction Z.

In particular, in the door frame 410, one surface 410*a* of the door frame 410 arranged adjacent to the blower fan 260 may be arranged at a predetermined angle θ1 in the left-right direction Y perpendicular to the upper-lower direction Z. This is because, in the damper 400, the one surface 410*a* of the door frame 410 facing the blower fan 260 is a region where the most collision with the circulated air occurs.

Accordingly, an opening 411 (see FIG. 11) formed on the one surface 410*a* of the door frame 410 is slantingly formed at the predetermined angle θ1 in the left-right direction Y perpendicular to the upper-lower direction Z.

Condensate water colliding with the one surface 410*a* of the door frame 410 facing the blower fan 260, the area of the door frame 410 at an inner side of the opening 411 of the one surface 410*a*, and the door 420 may flow to the lower end of the door frame 410 due to the slope in the left-right direction Y perpendicular to the upper-lower direction Z.

As the damper 400 is arranged to be inclined in the left-right direction Y perpendicular to the upper-lower direction Z, the condensate water may flow to the lowermost end in the upper-lower direction Z and the left-right direction Y along the slope.

The other surface 410*b* arranged on the opposite side of the one surface 410*a* of the door frame 410 may be arranged parallel to the upper-lower direction Z. However, the disclosure is not limited thereto, and the other surface 410*b* may be arranged parallel to the one surface 410*a*.

In addition, referring to FIG. 10, the damper 400 may be additionally obliquely arranged at a predetermined angle θ2 in the front-rear direction X perpendicular to the upper-lower direction Z.

In detail, the door frame 410 may extend to be inclined at a predetermined angle θ2 in the front-rear direction X perpendicular to the extension direction Z of the duct plate 410.

Accordingly, the openings 411 and 412 formed on the both surfaces 410*a* and 410*b* of the door frame 410 are all inclined at the predetermined angle θ2 in the front-rear direction X perpendicular to the extension direction Z.

Condensate water colliding with the one surface 410*a* and the other surface 410*b* of the door frame 410, the area of the door frame 410 formed inside the opening 411 of the one surface 410*a* and the opening 412 of the other surface 410*b*, and the door 420 may flow to the lower end of the door frame 410 by the slope in the front-rear direction X perpendicular to the upper-lower direction Z.

The damper 400 may be arranged to be inclined with three-dimensions. Accordingly, when condensate water is generated inside the damper 400, in detail, on the door 420 or the door frame 410, the condensate water may be easily drained to the lowermost end in the front-rear direction X and left-right direction Y of the damper 400 along the slope.

In detail, referring to FIG. 11, the door frame 410 may include a drain part 413 arranged at the lowermost end in the front-rear direction X and the left-right direction Y.

The opening 411 of the one surface 410*a* is provided at an inner side with a guide part 414 provided to guide the condensate water formed inside the door frame 410 to the drain part 413.

The guide part 414 may be a region extending from a region in which the door 420 is arranged to the opening 411 on the one surface 410*a*, and may be formed to be inclined in the front-rear direction X and the left-right direction Y with respect to the upper-lower direction Z.

Accordingly, condensate water formed due to collision within the door 420 or the inner side of the door frame 410 may be gathered in the drain part 413 along the slope of the guide unit 414.

In addition, condensate water formed by colliding with the one surface 410*a* of the door frame 410 may be gathered in the drain part 413 along the slope because the one surface 410*a* is also formed to be inclined.

The drain part 413 may include a shape that is cut downward such that the condensate water collected on the drain part 413 is fallen.

Although not shown in the drawings, the region corresponding to the position of the drain part 413 in the damper housing part 272 covering the door frame 410 may include a cut-out shape so that the drain part 413 communicates with the outside.

Accordingly, the condensate water collected in the drain part 413 may be drained to the outside of the damper 400 and the freezing chamber duct 200.

As described above, the evaporator E may be arranged at a lower side of the freezing chamber duct 200 (see FIG. 3). Accordingly, the condensate water dripping from the drain part 413 reaches the surface of the evaporator E, and the condensate water may be frozen on the evaporator E.

The condensate water frozen on the evaporator E may be defrosted by heat generated in the evaporator E during a defrosting process of the refrigerator 1.

As described above, condensate water generated inside the damper 400 may be easily frozen due to the low temperature inside the freezing chamber duct 200, but since the damper 400 is arranged to be inclined, the generated condensate water may be easily drained outside of the damper 400 and the freezing chamber duct 200 along the slope, so that the damper 400 may be stably driven.

Hereinafter, the connection duct 300 according to an embodiment of the disclosure will be described in detail.

Figure 12:
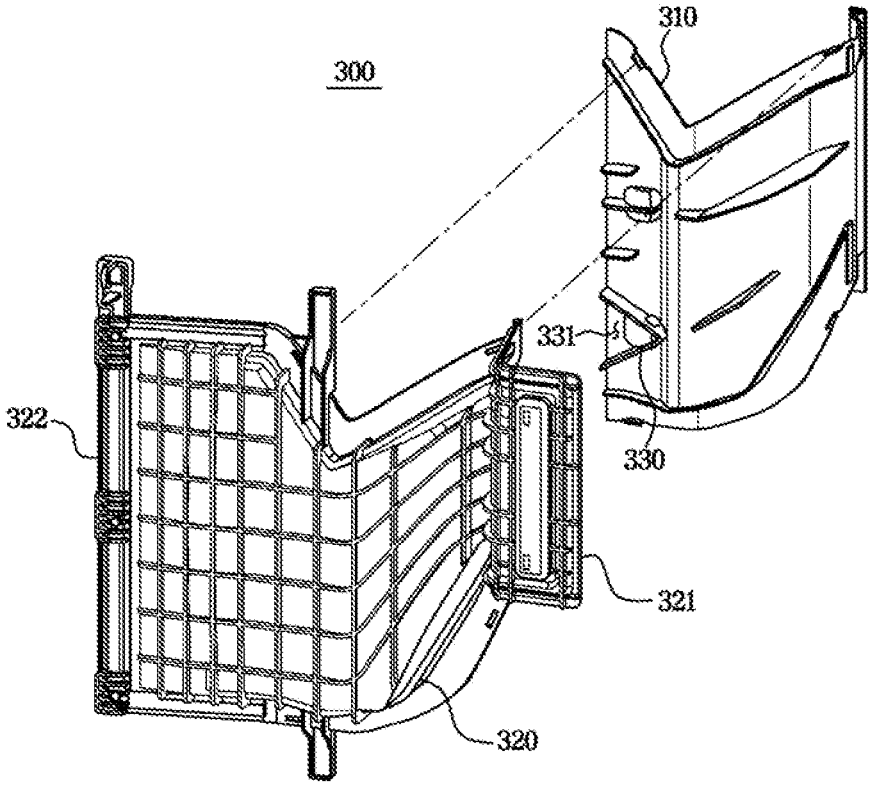
FIG. 12 is an exploded perspective view illustrating a connection duct according to an embodiment of the disclosure.

FIG. 12 is an exploded perspective view illustrating a connection duct according to an embodiment of the disclosure.

The connection duct 300 may connect the freezing chamber duct 200 to the refrigerating chamber duct 100 as described above.

One end 321 of the connection duct 300 may be coupled to the freezing chamber inner case 41 and communicate with the outlet 250 of the freezing chamber duct 200 through the opening 41*b* of the freezing chamber inner case 41.

The other end 322 of the connection duct 300 may be coupled to the refrigerating chamber inner case 42 and may communicate with the connector 150 of the refrigerating chamber duct 100 through the opening 42*b* of the refrigerating chamber inner case 42.

A region between the one end 321 and the other end 322 of the connection duct 300 may be provided in a shape including a curved surface to facilitate the flow of air flowing in the connection duct 300.

Although not shown in the drawings, each of the one end 321 and the other end 322 of the connection duct 300 may include an opening formed at an inside thereof and provided to communicate with the internal air passage of the connection duct 300.

The connection duct 300 may be provided in a shape in which a first housing 310 and a second housing 320 are coupled to each other. The one end 321 and the other end 322 of the connection duct 300 may be formed on the second housing 320.

However, the disclosure is not limited thereto, and the one end 321 and the other end 322 of the connection duct 300 may be formed by the first housing 310, and may be formed by assembling the first housing 310 and the second housing 320.

As the first housing 310 is coupled to the second housing 320, an air flow passage may be formed between the first housing 310 and the second housing 320.

The connection duct 300 may include a rib 330 arranged inside the air passage.

As described above, a freezing of condensate water may occur on the damper 400. The freezing is a freezing that is generated by condensate water contained in air circulated by the blower fan 260.

However, unlike the above, when the door 420 of the damper 400 is in a closed state, air inside the refrigerating chamber 22 may be reversely introduced into the side of the damper 400 through the connection duct 300.

In this case, water vapor in the air inside the refrigerating chamber 22 may move toward the damper 400 and collide with the door 420 of the damper 400 or the other surface 410*b* of the door frame 410 to form condensate water.

In particular, when condensed water is formed between the inside of the opening 412 of the other surface 410*b* of the door 420 and the door 420 and frozen, the door 420 is restricted from being driven.

The connection duct 300 according to an embodiment of the disclosure, in order to prevent water vapor in the air flowing from the side of the refrigerating chamber 22 to the connection duct 300 from colliding with the damper 400 and freezing inside the damper 400, may include the rib 330 arranged on the air passage inside the connection duct 300.

The rib 330 may be provided in a shape, a cross-sectional area of which gradually increases from the one end 321 of the connection duct 300 to the other end 322 of the connection duct 300.

This is to minimize the restriction of the flow of air while air flows from the freezing chamber duct 200 to the refrigerating chamber duct 100 by the blower fan 260.

Conversely, when the door 420 is closed, the flow of air from the refrigerating chamber duct 100 to the freezing chamber duct 200 may be limited by the shape of the rib 330.

The rib 330 may be provided in a shape extending in a direction opposite to the direction from the refrigerating chamber duct 100 to the freezing chamber duct 200.

Accordingly, a portion of the air flowing into the freezing chamber duct 200 may be blocked by the rib 330 without reaching the damper 400, but may flow back to the refrigerating chamber duct 100.

In addition, the rib 330 may include a collecting part 331 capable of collecting condensate water generated due to collision of air.

Accordingly, when the air flowing into the freezing chamber duct 200 collides with the ribs 330, the direction of the air flow may be changed, and at the same time as the collision, condensate water may be generated, and the condensate water may be collected in the collecting part 331.

That is, in the case of air flowing in the refrigerating chamber duct 100, the flow of the air may be switched before reaching the damper 400 by the rib 330, or moisture in the air may be collected by the collecting part 331 of the rib 330 so that moisture is prevented from reaching the damper 400.

Hereinafter, a damper 400 of the refrigerator 1 according to another embodiment of the disclosure will be described. Configurations other than the damper 400 described below are the same as those of the refrigerator 1 according to the embodiment of the disclosure described above, and thus the same descriptions will be omitted.

Figure 13:
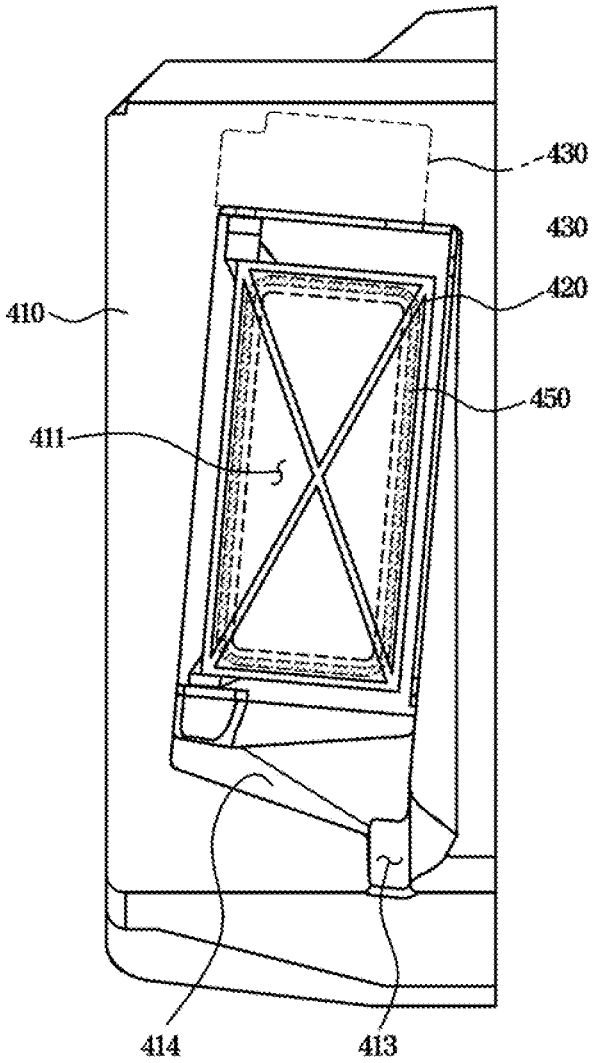
FIG. 13 is a view illustrating a damper according to another embodiment of the disclosure.

FIG. 13 is a view illustrating a damper according to another embodiment of the disclosure.

The damper 400 may include a heating wire 450 installed into a contact portion 415 that is in contact with a surface of the door 420 when the door 420 is closed.

Water vapor in the air collides with the contact portion 415 to generate condensate water, and when the door 420 is in a closed state, freezing may occur on the door 420 and the contact portion 415, so that the door 420 may be precluded from being separated the contact portion 415.

Accordingly, a malfunction may occur in the driving part 430 and the driving part 430 may be damaged, and the temperature of the refrigerating chamber 22 may not be controlled.

Among the limitations associated with formation of ice in the damper 400, ice formation occurring between the contact portion 415 and the door 420 may be the greatest concern.

According to the embodiment of the disclosure, the damper 400 includes the heating wire 450 installed into the contact portion 415 to eliminate the limitation.

The heating wire 450 may be periodically driven to perform defrosting on the contact portion 15, or when a malfunction occurs in the driving part 430, the heating wire 450 may be driven through a controller (not shown) to defrost the contact portion 415.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

The invention claimed is:

1. A refrigerator comprising:

a main body;

a freezing chamber and a refrigerating chamber in the main body, the freezing chamber and the refrigerating chamber being arranged in a lateral direction;

an evaporator configured to generate cold air and arranged inside the main body;

a first duct disposed rearward of the freezing chamber to supply cold air to the freezing chamber;

a second duct disposed rearward of the refrigerating chamber to supply cold air to the refrigerating chamber;

a connection duct provided between the first duct and the second duct and configured to guide cold air from the first duct to the second duct; and a damper arranged inside the first duct and controlling flow of cold air from the first duct to the connection duct, and thereby controlling supply of cold air to the second duct, wherein the second duct comprises a discharge port formed on a front surface of the second duct so that cold air in the second duct is supplied to the refrigerating chamber and a connector formed on a rear surface of the second duct to communicate with the connection duct.

2. The refrigerator of claim 1, wherein the second duct does not include a portion that protrudes further than the flat front surface.

3. The refrigerator of claim 1, further comprising a freezing chamber inner case configured to form the freezing chamber, a refrigerating chamber inner case configured to form the refrigerating chamber, and a cooling passage in which the evaporator is arranged and which is formed between the first duct and the freezing chamber inner case.

4. The refrigerator of claim 3, wherein the first duct is provided to communicate with the cooling passage, and the first duct includes a blower fan that allows cold air in the cooling passage to flow to the first duct and the second duct.

5. The refrigerator of claim 1, the second duct is arranged further rearward than the first duct in a front-rear direction.

6. The refrigerator of claim 5, wherein the connection duct has one end coupled to a side surface of the first duct, and an other end of the connection duct coupled to the rear surface of the second duct.

7. The refrigerator of claim 1, wherein the damper is arranged to be inclined in a first direction that is vertically perpendicular to a front-rear direction.

8. The refrigerator of claim 7, wherein the damper is arranged to be inclined in a second direction that is horizontally perpendicular to a front-rear direction.

9. The refrigerator of claim 8, wherein the damper further includes a drain provided at a lower end of the damper to drain condensate water.

10. The refrigerator of claim 9, wherein the drain is provided so that the condensate water drained from the drain falls toward the evaporator.

11. The refrigerator of claim 1, wherein the damper includes a door configured to selectively open and close the connection duct, and a driver configured to drive the door frame and the door.

12. The refrigerator of claim 11, wherein the door is configured to rotate in a direction toward the first duct from the connection duct to open the connection duct.

13. The refrigerator of claim 11, wherein the door frame includes a heating wire arranged in an area that is in contact with the door frame while the door is in a closed state.

14. The refrigerator of claim 1, wherein the connection duct includes a rib that is arranged inside the connection duct and including a collecting part formed in a direction toward an other end of the connection duct.

15. The refrigerator of claim 3, wherein the connector communicates with an end of the connection duct through an opening of the refrigerating chamber inner case.

* * * * *